US007101258B2

(12) United States Patent
Ising

(10) Patent No.: US 7,101,258 B2
(45) Date of Patent: Sep. 5, 2006

(54) DOUBLE SIDED POLISHING MACHINE

(75) Inventor: Ulrich Ising, Budelsdorf (DE)

(73) Assignee: Peters Wolters Surface Technologies GmbH & Co., KG, Rensburg (DE)

( * ) Notice: Subject to any disclaimer, the term of this patent is extended or adjusted under 35 U.S.C. 154(b) by 0 days.

(21) Appl. No.: 11/103,733

(22) Filed: Apr. 12, 2005

(65) Prior Publication Data

US 2006/0040589 A1 Feb. 23, 2006

(30) Foreign Application Priority Data

Aug. 20, 2004 (DE) ..... 10 2004 040 429

(51) Int. Cl.
*B24B 7/22* (2006.01)

(52) U.S. Cl. ..... 451/7; 451/268; 451/488

(58) Field of Classification Search ..... 451/7, 451/268, 269, 53, 488, 270, 271, 290–291
See application file for complete search history.

(56) References Cited

U.S. PATENT DOCUMENTS 4,007,560 A * 2/1977 Janssen ..... 451/262
4,315,383 A * 2/1982 Day ..... 451/269
4,450,652 A * 5/1984 Walsh ..... 451/7
4,471,579 A * 9/1984 Bovensiepen ..... 451/7
5,782,678 A * 7/1998 Cesna et al. ..... 451/269
6,544,111 B1 * 4/2003 Kimura et al. ..... 451/288

* cited by examiner

*Primary Examiner*—Robert A. Rose
(74) *Attorney, Agent, or Firm*—Vidas, Arrett & Steinkraus, P.A.

(57) ABSTRACT

Double-sided polishing machine with an upper and a lower working disc, each comprising a polishing disc and a carrier disc. The working disc are co-axially arranged and rotatable relative to each other, a polishing gap being formed between the polishing discs. Said workpieces are machined in the polishing gap. A temperature control device being at least provided for the upper working disc by which a temperature control fluid can be conveyed through passages in the upper working disc. A spacing measuring device being associated with the working discs which measure the spacing in the polishing gap (gap width μ) at two radial spaced points of the polishing gap.

9 Claims, 2 Drawing Sheets

DOUBLE SIDED POLISHING MACHINE

CROSS-REFERENCE TO RELATED APPLICATIONS

Figure 1:
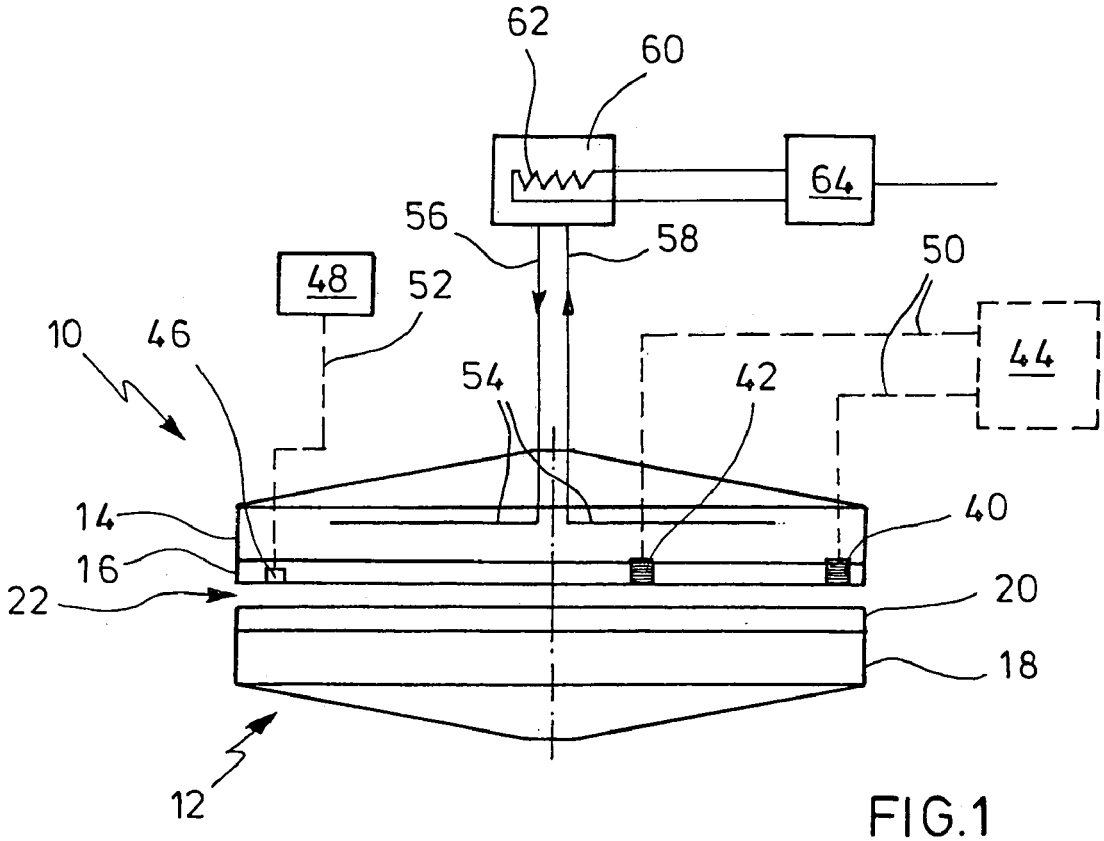

Not applicable.

STATEMENT REGARDING FEDERALLY SPONSORED RESEARCH

Not applicable.

BACKGROUND OF THE INVENTION

Double-sided polishing machines serve for polishing workpieces having coplanar surfaces, e.g. wafers. The plane parallelism is an essential quality criterion.

A double-sided polishing machine usually has two working discs which are rotationally driven by a shaft, preferably in opposite sense to each other. The shafts are co-axial. Each working disc includes a polishing disc and a carrier disc. Usually, the polishing disc has a steel disc which is firmly secured to the carrier disc. The facing surfaces of the polishing disc are covered by a polishing pad. The flat workpieces are accommodated by openings of so-called runner discs which can be rotationally driven by means of a tooth ring or a pin ring respectively. The workpieces move along a cycloidal path between the working disc or the polishing gap, respectively. The effective polishing surface of the upper and lower working disc thus is an annular surface.

Usually, a polishing medium is introduced into the polishing gap in form of a suspension. It is known to use the polishing medium for cooling purposes in that it flows on one side through passages between the carrier and the polishing disc and on the other side into the polishing gap through axial parallel bores in the polishing disc. It is further known to provide cooling passages between the carrier disc and the polishing disc (labyrinth) into which cooling medium is introduced e.g. water. The cooling medium is fed through axial passages in the driving shaft which are connected to an outer stationary cooling source through a rotary coupling.

Since the workpieces are moved in the polishing gap between upper and lower polishing disc the geometry (parallelism of the surfaces) is considerably determined by the geometry of the polishing discs i.e. through the difference in geometry between the upper and the lower polishing discs i.e. the polishing gap.

As already mentioned the temperature necessary for polishing performance can be controlled by a suitable cooling medium. At the beginning of the polishing step the temperature is for example 40° C. During the polishing process a considerable process temperature is generated. This deforms the polishing discs. As mentioned carrier disc and polishing disc are firmly interconnected and thus result in a different extension of both discs so that the working surface of the concerned polishing disc attains a convex shape. If the temperature in the polishing disc is reduced this results in a uniform polishing gap again.

The object of the invention is to provide a double-sided polishing machine wherein at any time an approximately uniform polishing gap is achieved throughout the radius of the polishing surface.

BRIEF SUMMARY OF THE INVENTION

In the double sided polishing machine according to the invention a spacing measuring device is associated with the working discs which measures the spacing between the polishing disc (gap width) at least at two radially spaced points of the polishing gap. If the measured spacing is equal at least at two points, the parallelism of the working surfaces of the polishing disc can be assumed. If, however, the spacing is different an undesired deformation of the polishing disc can be stated at least if a prior measurement yielded to parallelism. It is understood that inaccuracies of the machining of the working surfaces of the polishing disc must be out of consideration.

It is conceivable to measure the spacings between the polishing pads, however, it is easier and more accurate to measure the spacing between the facing working surfaces of the polishing disc which conventionally are of steel.

According to an embodiment of the invention, preferably the spacing is measured radially inwards and radially outwards in the polishing gap. This allows a good judgement whether a temperature induced deformation of the polishing disc has taken place.

Various sensors could be used to measure the spacing. In an embodiment of the invention eddy current sensors are proposed. Eddy current sensors rely on the principle that by the aid of an alternating field of the sensor, an eddy current is generated in the opposed polishing disc which in turn results in an electrical field which is measured by the measuring means of the sensor. The strength of the received field is a measure of the spacing. It is understood that such measurement of the spacing can be carried out only if no workpiece or a runner disc is in the area of the sensors because otherwise the measurement result would be wrong. For an eddy current sensor a coil for the generation of the transmission field is necessary as well as a receiving coil to receive the field generated by the eddy current.

The knowledge of a deformation of the polishing disc by the measurement of the spacing can be used to compensate for the effects thereof or to provide means to annul the deformation.

An embodiment of the invention provides that within the carrier disc for at least the upper working disc fluid passages are induced for the throughflow of a temperature controlling fluid. The fluid passages are connected to a controllable source for a temperature controlling fluid. For example, a control liquid is used which is stored in a stationary volume. The storing volume can be connected with the temperature controlling passages of the carrier disc through a rotary coupling and axial passages in the shaft for the upper working disc. The volume of the store for the temperature controlling liquid can be relatively small sized e.g. equal or slightly larger than the volume of the temperature controlling passages. This allows to rapidly change the temperature of the fluid in order to rapidly change the temperature of the carrier disc.

Furthermore, a temperature measuring device is provided for measuring the temperature of the polishing disc. The temperature of the polishing pad can be measured partially or additionally. The temperature of the temperature controlling fluid or of the carrier disc, respectively, is changed in response to the measured temperature.

It has already been mentioned that a temperature difference between carrier and polishing disc results in a deformation of the polishing disc and thus to a change of the polishing gap over the radius thereof. If it is taken care that the temperature of the carrier disc is approximately that of the temperature of the polishing disc undesired deformation of the polishing disc is avoided. Thus, by means of the double-sided polishing machine according to the invention it is possible to keep the gap geometry during the polishing press continuously constant independent of the process temperature and the polishing pressure which in turn causes a predetermined temperature.

In order to keep the polishing gap constant, the device according to the invention provides for control means. It includes a first controller which determines a desired temperature value out of the difference between a desired value for the polishing gap and measured actual values for the polishing gap. A second controller calculates an adjusting value for control means for the temperature control means from the measured actual temperature values of the polishing disc and the desired temperature value of the first controller. Preferably, a heating and a cooling device as well are associated with the store for the temperature controlling medium in order to rapidly achieve the desired temperature.

It is understood that the described invention is independent of whether a cooling device is associated with the working disc in order to limit the process temperature to a maximum value. Such cooling means as already mentioned are known for such polishing machines.

It is also understood that other measures or means are conceivable to annul or compensate for undesired deformation of the polishing disc e.g. by deformation of the carrier disc e.g. by mechanical or magnetic means.

DETAILED DESCRIPTION OF THE INVENTION

Figure 2:
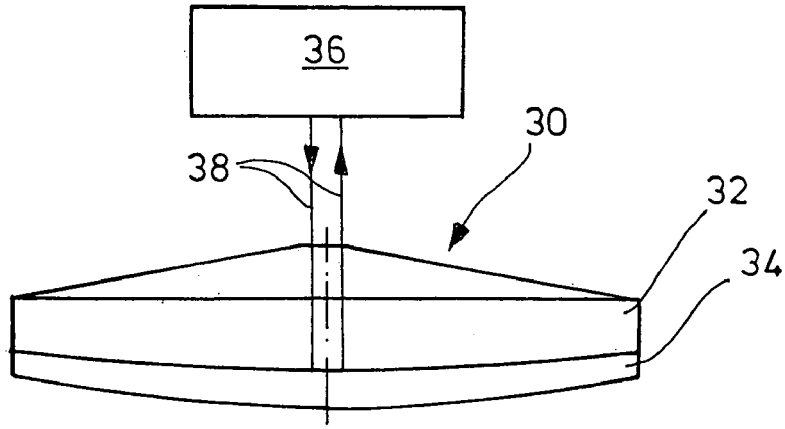
Figure 3:
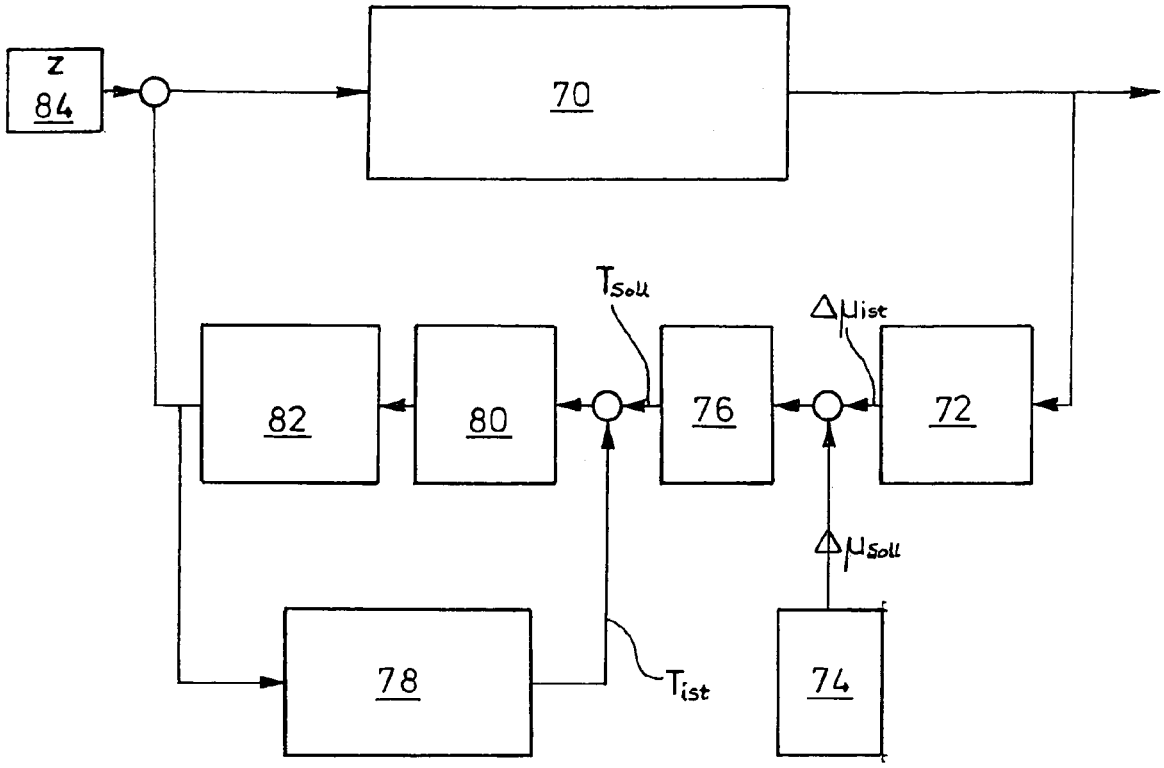

While this invention may be embodied in many different forms, there are described in detail herein a specific preferred embodiment of the invention. This description is an exemplification of the principles of the invention and is not intended to limit the invention to the particular embodiment illustrated An embodiment example is to be subsequently described with reference to drawings wherein FIG. 1 shows extremely diagrammatically the working disc of a double-sided polishing machine with means according to the invention;

FIG. 2 shows the upper working disc of a double-sided polishing machine according to the prior art and FIG. 3 shows a circuit for control means for controlling the temperature of the carrier disc of the upper working disc of FIG. 1.

In FIG. 1 an upper working disc 10 and a lower working disc 12 of a double-sided polishing machine can be seen. All other parts of such a machine are omitted. The upper and the lower working disc 10, 12 each are rotationally driven by a shaft in opposite rotational directions. The upper working disc 10 can be raised relative to the lower disc 12 and can be also moved laterally in order to load runner disc and workpieces in the runner disc on the lower working disc 12 or, respectively, to remove these parts. Runner discs and work pieces (e.g. wafer) are also not shown as well as the driving means for the runner discs. These parts are known in the prior art.

The upper working disc has a carrier disc 14 and a polishing disc 16. The lower working disc has a lower carrier disc 18 and a lower polishing disc 20. A polishing gap 22 is formed between the polishing disc 16, 20. The facing working surfaces of the polishing disc 16, 20 are covered by polishing cloth or pad (not shown). The pressure by which the upper working disc effects on the workpieces is caused by the weight of the upper working disc 10 and possible by an additional pressure which effects on the shaft therefore. Such a pressure is predetermined for a polishing process. By the way, it is known to suspend the upper working disc on the driving shaft though an universal joint in order to achieve parallelism in the polishing gap 12. This is mandatory in order to achieve coplanar outer surfaces for the workpieces.

In FIG. 2 an upper working disc 30 is shown having a carrier disc 32 and a polishing disc 34. Similar to FIG. 1 also in this case of FIG. 2 carrier disc 32 and polishing disc 34 are firmly attached to each other. In FIG. 2 further a cooling device 36 is shown which is connected to a labyrinth or passage system in working disc 30 through passages 38 within the not shown shaft for the upper working disc 30. Such a cooling is known. If upon a polishing process, polishing disc 34 which usually is of steel and carrier disc 32 are differently heated, this leads for example to a convex shape of the working surface of the polishing disc 34. The radial expansion of the polishing disc 34 is larger than that of the carrier disc 32. Such an effect is avoided by the means of FIG. 1.

In FIG. 1 two sensors 40, 42 are connected to a spacing measuring device 64. The sensors 42, 40 e.g. eddy current sensors measure the spacing between the working surfaces of the polishing discs 16, 20 i.e. different radial points. As can be seen, sensor 42 is at the radially inner side of the annular polishing surface, and sensor 40 at the radially outer side. If the measured spacings (gap width) are equal, the working surface of polishing disc 16 is completely even. If, however, differences are measured, a deformation has taken place due to different temperatures of carrier disc 14 and polishing disc 16.

A temperature sensor 46 is also shown in FIG. 1 provided in polishing disc 16 which is connected to a temperature measuring device 48. The stationary devices 44, 48 are connected to the working disc 10 through conduits 50, 52 within the not shown hollow shaft for the upper working disc 10, that is through a not shown collecting assembly. Such signal transfer means are known.

In FIG. 1 further temperature control passages 54 are indicated in the upper working disc 14 which are connected with a stationary storage volume 60 for control fluid through a supply passage 56 and an exit passage 58. The passages 56, 58 are also within the not shown shaft for the upper working disc, the connection of passages 56, 58 with the storage volume 60 taking place through a not shown rotary coupling.

A temperature controlling coil 62 is located within the storage volume for the temperature controlling fluid, the coil being supplied by a cooling and/or heating devise 64. By means of device 64 it is possible to rapidly adjust the temperature of the fluid in the storage volume and thus to influence the temperature of the carrier disc 14. During the polishing process the temperature of the carrier disc 14 should have approximately the same temperature as the polishing disc 16.

The geometry of the polishing gap (FIG. 1) can be controlled by a control circuit of FIG. 3. Thus, the gap geometry is the control path 70 to be controlled. The spacing measuring device is shown at 72 which for example is represented by the sensors 40, 42 (FIG. 1). Through block 74 a desired value for the uniformity of the spacing or the gap width, respectively, is outputted. It is desired that the difference is zero. A first controller 76 calculates a desired value $T_{soll}$ out of the desired value for the gap width and the measured difference of the gap widths. The desired value $T_{soll}$ is compared with the actual temperature value $T_{ist}$. The first temperature is measured for example by sensor 46. In FIG. 3 the temperature measuring device is shown at 78. The temperature difference is put into a second controller (temperature controller) 80 with generates a control or a adjusting signal for the cooling or heating device which in FIG. 3 is designated with 82 and which may correspond to coil 62 of device 64 in FIG. 1. It is understood that separate devices for cooling and heating can be provided. The heating for example can be generated by a resistance heating (i.e. an electrical one) while the cooling can be carried out otherwise. With respect to FIG. 3 it is to be added that the difference of the measuring values of the sensors 40, 42 are designated with $\Delta\mu$. Furthermore, it should be mentioned that the variable disturbance value which is essentially caused by the process heat is designated with Z in FIG. 3 (block 84).

It is further to be mentioned that the temperature change of the carrier disc 14 can be achieved also in another way in that a heating or cooling device is integrated in the carrier disc e.g. in form of an electrical heating device in the carrier disc 14.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A double-sided polishing machine having an upper and a lower working disc, each working disc comprising a polishing disc and a carrier disc, the working discs being co-axial and rotationally driven relative to each other, a polishing gap being formed between the polishing discs wherein flat workpieces are machined on both sides, the polishing machine further includes temperature control means at least for the upper working disc by which temperature fluid is conveyed into the upper working disc via fluid passages, a measuring device being associated with the working discs which measures the spacing between the polishing discs at least at two radially spaced points of the polishing gap.

2. The double-sided polishing machine of claim 1, wherein fluid passages for the temperature fluid we provided within the carrier disc of at least the upper working disc, the fluid passages being connected to a source for temperature fluid, the temperature of the source being controllable, a temperature measuring device is provided for measuring the temperature of the polishing disc and control means are provided to change the temperature of the carrier disc in response to the temperature measured by the temperature measuring device.

3. The double-sided polishing machine of claim 1, wherein at least a first sensor is located radially inwards and at least a second sensor is located radially outwards with reference to the upper polishing disc.

4. The double-sided polishing machine of claim 1, wherein eddy current sensors are provided for measuring the gap width.

5. The double-sided polishing machine of claim 3, wherein the upper working disc is driven by a shaft, and the sensors are connected to a stationary spacing measuring device.

6. The double-sided polishing machine of claim 3, wherein the upper working disc is driven by a shaft and the fluid source is connected with temperature control passages in the carrier disc.

7. The double-sided polishing machine of claim 2, wherein a first controller determines a desired temperature value $T_{soll}$ out of the difference of a desired value $\Delta\mu_{soll}$ for the gap width and measured actual values $\Delta\mu_{ist}$, and a second controller calculates a control value for control means from the measured actual temperature of the polishing disc and the desired temperature value $T_{soll}$ for the polishing disc.

8. The double-sided polishing machine of claim 2, wherein the controllable fluid source includes a storage for temperature control liquid, the volume of the storage is approximately similar to the volume of the temperature passages, and the fluid storage includes a heating and cooling device.

9. The double-sided polishing machine of claim 1, wherein a separate cooling circuit is associated with the working disc having cooling passages in the polishing disc.

* * * * *